US011107611B2

(12) United States Patent
Yonezawa et al.

(10) Patent No.: US 11,107,611 B2
(45) Date of Patent: Aug. 31, 2021

(54) THERMISTOR ELEMENT AND METHOD FOR PRODUCING SAME

(71) Applicant: MITSUBISHI MATERIALS CORPORATION, Tokyo (JP)

(72) Inventors: Takehiro Yonezawa, Naka (JP); Kazutaka Fujiwara, Naka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

(21) Appl. No.: 16/962,349

(22) PCT Filed: Jan. 17, 2018

(86) PCT No.: PCT/JP2018/002171
§ 371 (c)(1),
(2) Date: Jul. 15, 2020

(87) PCT Pub. No.: WO2019/142367
PCT Pub. Date: Jul. 25, 2019

(65) Prior Publication Data
US 2020/0343026 A1 Oct. 29, 2020

(51) Int. Cl.
*H01C 7/00* (2006.01)
*H01C 1/14* (2006.01)
*H01C 17/28* (2006.01)

(52) U.S. Cl.
CPC ..... *H01C 7/008* (2013.01); *H01C 1/14* (2013.01); *H01C 17/281* (2013.01)

(58) Field of Classification Search
CPC ..... H01C 7/008; H01C 1/14; H01C 17/281
(Continued)

(56) References Cited

U.S. PATENT DOCUMENTS 4,603,007 A 7/1986 Shibata et al.
2002/0036563 A1* 3/2002 Ogata ..... H01C 7/025 338/22 R

FOREIGN PATENT DOCUMENTS

JP S61-24101 A 2/1986
JP S62-95805 A 5/1987
(Continued)

OTHER PUBLICATIONS

International Search Report dated Apr. 17, 2018, issued for PCT/JP2018/002171.
(Continued)

*Primary Examiner* — Edwin A. Leon
*Assistant Examiner* — Iman Malakooti
(74) *Attorney, Agent, or Firm* — Locke Lord LLP

(57) ABSTRACT

Provided are a thermistor element including a conductive intermediate layer containing $RuO_2$ which can have a lower resistance and a thinner profile, whereby the increase in resistance can be suppressed even when peeling of the electrode proceeds; and a method for producing the same. The thermistor element according to the present invention includes: a thermistor body 2 made of a thermistor material; a conductive intermediate layer 4 formed on the thermistor body; and an electrode layer 5 formed on the conductive intermediate layer, wherein the conductive intermediate layer has an aggregation structure of $RuO_2$ particles that are in electrical contact with each other where $SiO_2$ is placed in the gaps in the aggregation structure, and has a thickness of 100 to 1000 nm.

5 Claims, 4 Drawing Sheets

(58) Field of Classification Search
USPC ..... 338/22 R
See application file for complete search history.

(56) References Cited

FOREIGN PATENT DOCUMENTS

| | | | | | |
|---|---|---|---|---|---|
| JP | H05-190091 | A | | 7/1993 | |
| JP | H09186002 | | * | 7/1997 | ..... H01C 1/142 |
| JP | 3661160 | B2 | | 6/2005 | |

OTHER PUBLICATIONS

Office Action dated Feb. 25, 2021, for the corresponding Taiwanese Patent Application No. 107101988 and English translation thereof.

* cited by examiner

[FIG. 2]

[FIG. 3]
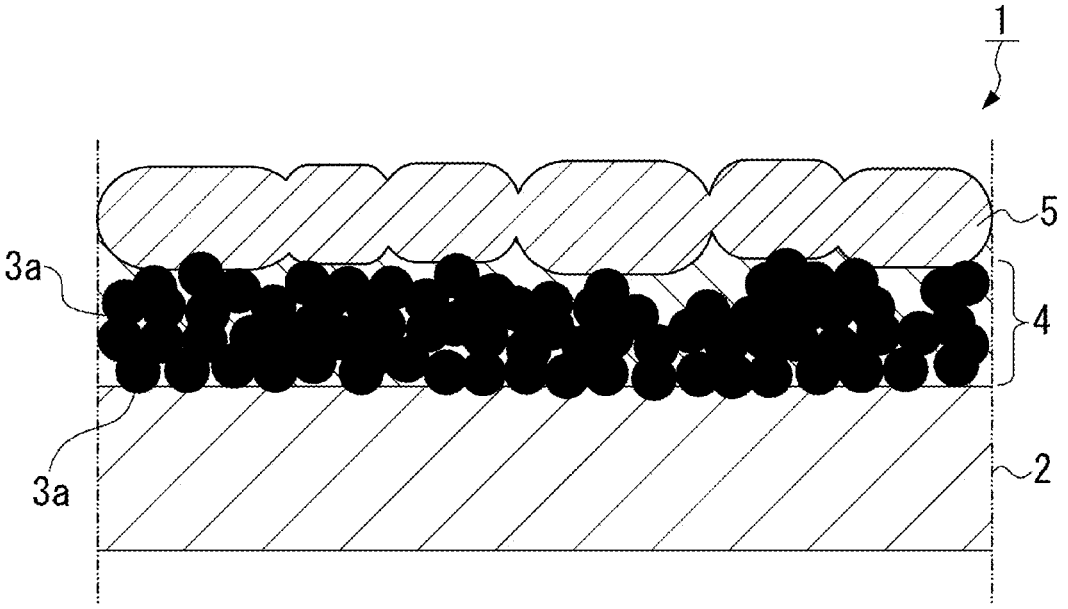
[FIG. 4]
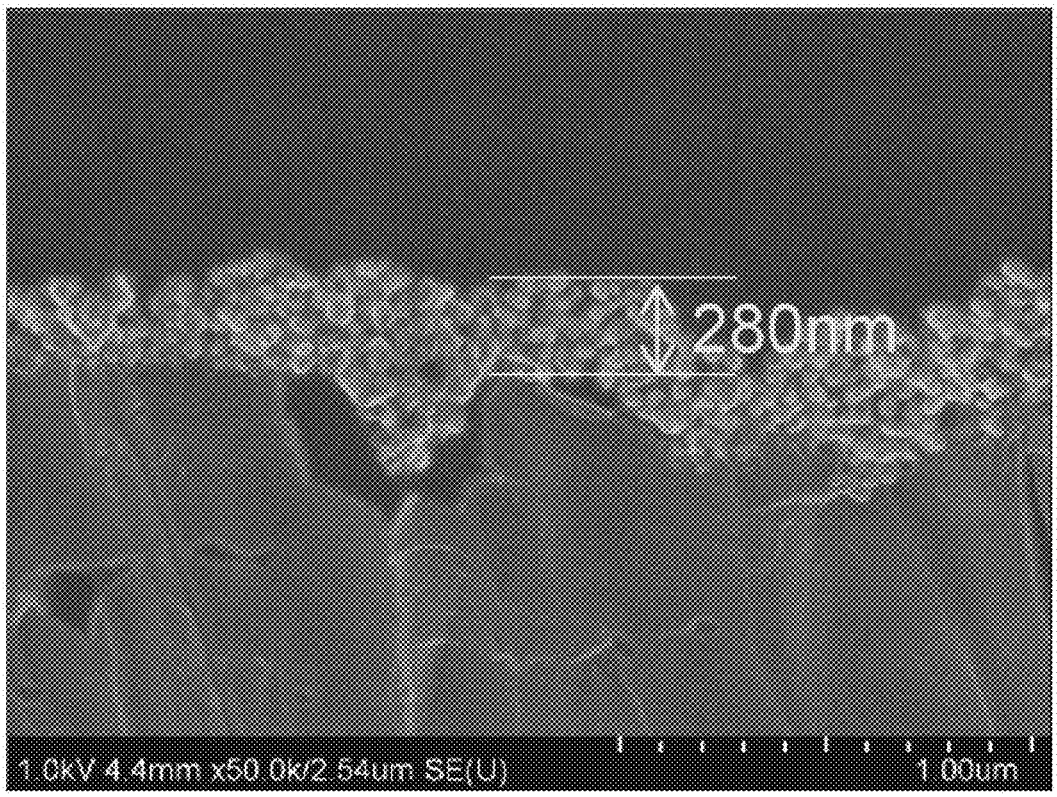

[FIG. 5]
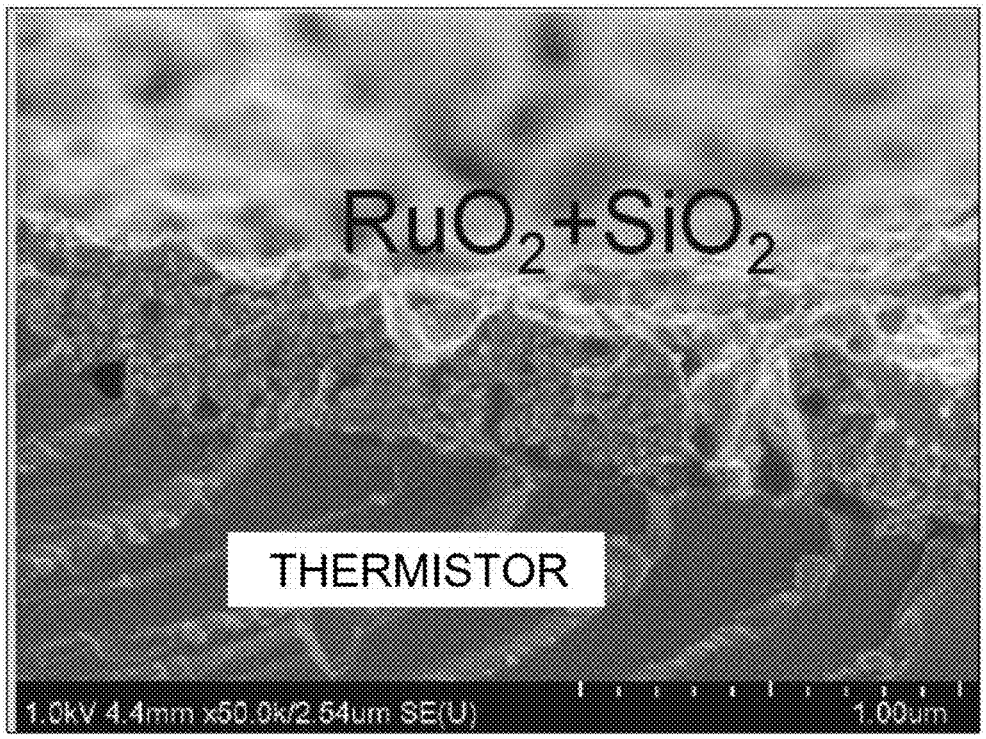
[FIG. 6]
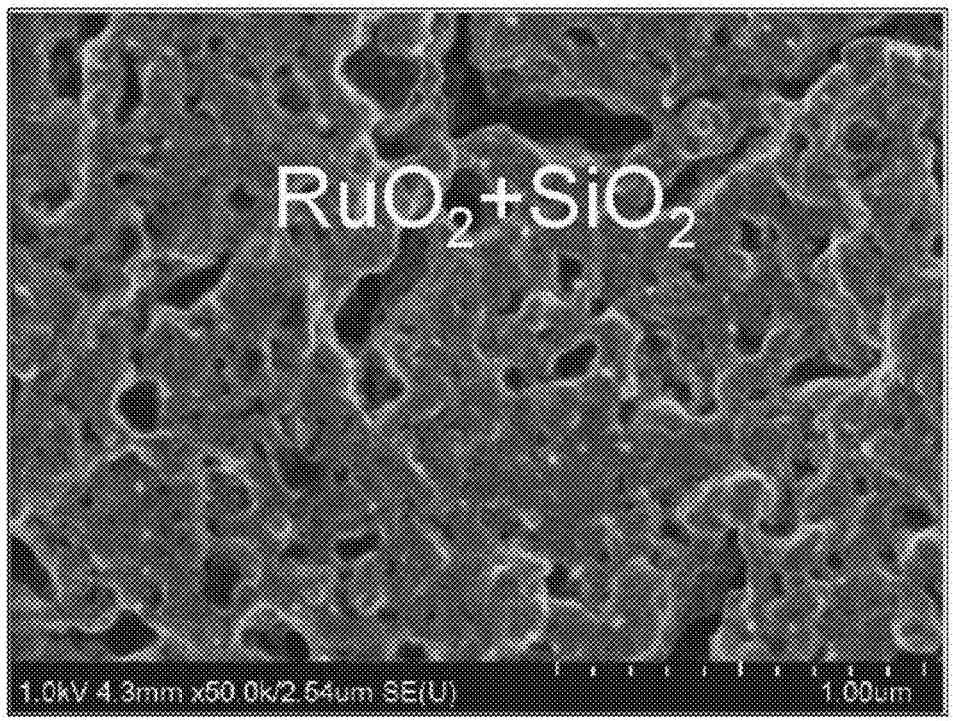

[FIG. 7]
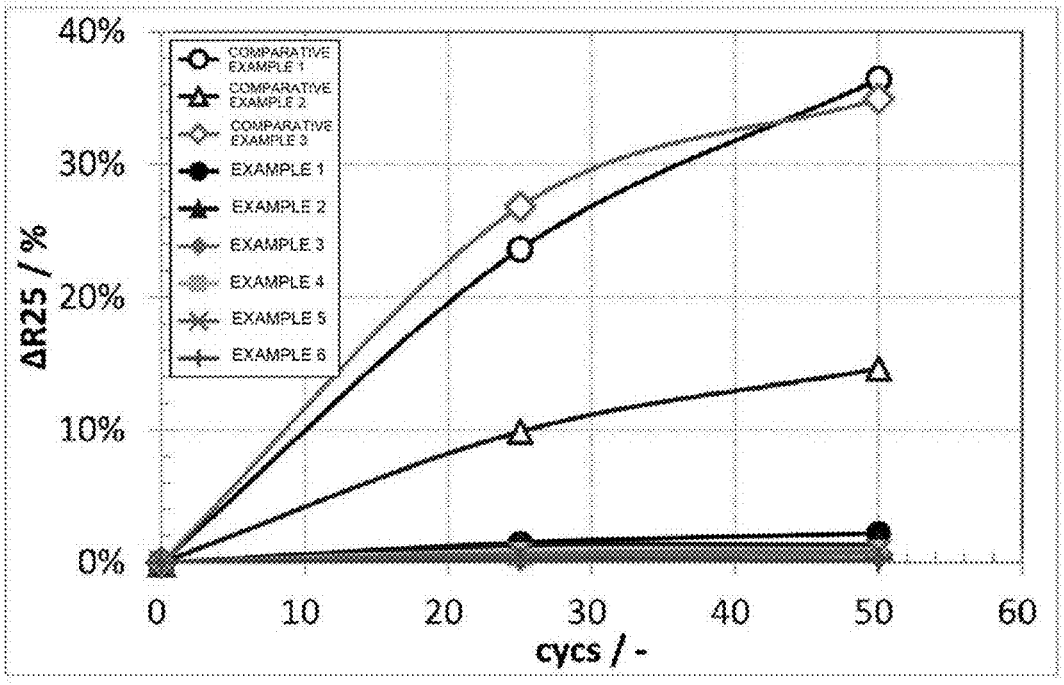

THERMISTOR ELEMENT AND METHOD FOR PRODUCING SAME

BACKGROUND OF THE INVENTION

Field of the Invention

The present invention relates to a reliable thermistor element that exhibits a small change in resistance in, for example, a heat cycle test or the like; and a method for producing the same.

Description of the Related Art

In general, thermistor temperature sensors are employed as the temperature sensors for automobile-related technologies, information equipment, communication equipment, medical equipment, housing equipment, and the like. The thermistor element used for such a thermistor temperature sensor may often be used under a severe environment especially where the temperature is greatly changed a number of times.

Conventionally, such a thermistor element includes an electrode that is formed by applying a noble metal paste of Au or the like on the thermistor body.

For example, Patent document 1 discloses a thermistor which includes an electrode having a two-layered structure that consists of an element electrode formed on the thermistor body and a cover electrode formed on the element electrode, the element electrode being a film containing glass frit and $RuO_2$ (ruthenium dioxide) while the cover electrode being a film made from a paste containing a noble metal and glass frit. In this thermistor, the element electrode is formed into a film by applying a paste containing glass frit and $RuO_2$ on the surface of the thermistor body and then baking it. This element electrode ensures an electrode area so as to maintain the electrical characteristics of the thermistor, while the cover electrode made from the noble metal paste ensures the electrical connection of wiring with the element electrode by soldering.

PRIOR ART DOCUMENT

Patent Document

[Patent document 1] Japanese Patent No. 3661160

SUMMARY OF THE INVENTION

Problems to be Solved by the Invention

The following problems still remain in the conventional technology described above.

Specifically, in the conventional thermistor described above, since the intermediate layer of the electrode is formed by applying a paste containing glass frit and $RuO_2$ particles on the surface of the thermistor body and then baking it, the glass frit can get into gaps between the $RuO_2$ particles. This can block the electrical conduction between the $RuO_2$ particles in many parts, thereby disadvantageously causing the resistance of the intermediate layer to be increased. As described above, since the intermediate layer has a high resistance, when it is used in a heat cycle for a long period of time, the resistance can be significantly increased as peeling of the electrode proceeds. Moreover, since a paste containing $RuO_2$ particles having a high viscosity is applied on the surface of the thermistor body, the intermediate layer necessarily becomes thick and this may problematically increase the amount of the $RuO_2$ particles containing Ru, which is a rare metal, to be used.

The present invention has been made in view of the aforementioned circumstances, and an object of the present invention is to provide a thermistor element which include a conductive intermediate layer containing $RuO_2$ that can have a lower resistance and a thinner profile, whereby the increase in resistance can be suppressed even when peeling of the electrode proceeds; and a method for producing the same.

Means for Solving the Problems

The present invention adopts the following configuration in order to overcome the aforementioned problems. Specifically, a thermistor element according to a first aspect of the present invention comprises: a thermistor body made of a thermistor material; a conductive intermediate layer formed on the thermistor body; and an electrode layer formed on the conductive intermediate layer, wherein the conductive intermediate layer has an aggregation structure of $RuO_2$ particles that are in electrical contact with each other where $SiO_2$ is placed in the gaps in the aggregation structure, and has a thickness of 100 to 1000 nm.

In this thermistor element, since the conductive intermediate layer has an aggregation structure of $RuO_2$ particles that are in electrical contact with each other where $SiO_2$ is placed in the gaps in the aggregation structure, and has a thickness of 100 to 1000 nm, the aggregation structure of the $RuO_2$ particles that are in contact with each other can assure enough electrical conductivity, and the $SiO_2$ that is placed in the gaps in the porous structure can serve as a binder for the aggregation structure. Therefore, the conductive intermediate layer can have a low resistance even if it is thin, whereby the increase in resistance can be suppressed even when peeling between the conductive intermediate layer and the electrode layer proceeds in a heat cycle test or the like.

A thermistor element according to a second aspect of the present invention is characterized by the thermistor element according to the first aspect of the present invention, wherein the rate of change in resistance at 25° C. is less than 2.5% before and after repeating a heat cycle test 50 times with one cycle consisting of a test conducted at −55° C. for 30 minutes and one at 200° C. for 30 minutes.

Specifically, with this thermistor element, since the rate of change in resistance at 25° C. is less than 2.5% before and after repeating the heat cycle test as described above, a temperature measurement can be stably performed with high reliability even under the environment where the temperature is greatly changed.

A method for producing a thermistor element according to a third aspect of the present invention comprises: an intermediate layer forming step for forming a conductive intermediate layer on the thermistor body made of a thermistor material and an electrode forming step for forming an electrode layer on the conductive intermediate layer, wherein the intermediate layer forming step includes applying a $RuO_2$ dispersion containing $RuO_2$ particles and an organic solvent on the thermistor body and drying it to form a $RuO_2$ layer, and applying a silica sol-gel solution containing $SiO_2$, an organic solvent, water, and an acid on the $RuO_2$ layer and drying it with the silica sol-gel solution being penetrated into the $RuO_2$ layer to form the conductive intermediate layer.

In this method for producing a thermistor element, since the intermediate layer forming step includes applying a $RuO_2$ dispersion containing $RuO_2$ particles and an organic solvent on the thermistor body and drying it to form a $RuO_2$ layer, the $RuO_2$ layer is formed with many of the $RuO_2$ particles that are in close contact with each other at this stage. Moreover, since a silica sol-gel solution containing $SiO_2$, an organic solvent, water, and an acid is applied on the $RuO_2$ layer and is dried with the silica sol-gel solution being penetrated into the $RuO_2$ layer to form the conductive intermediate layer, the conductive intermediate layer has an aggregation structure of the $RuO_2$ particles that are in close contact with each other where the silica sol-gel solution is penetrated into the gaps therein so that the $SiO_2$ is placed in the gaps after dried. Since the silica sol-gel solution can be cured when dried to provide a high purity of $SiO_2$, it can provide strength to the conductive intermediate layer and serve to make the thermistor body firmly adhered to the conductive intermediate layer. Therefore, compared to the conventional intermediate layer that is made from a $RuO_2$ paste containing glass frit which inhibits the $RuO_2$ particles from being in sufficiently close contact with each other, the $RuO_2$ layer of the present invention is advantageously formed using a $RuO_2$ dispersion containing no glass frit so that the $RuO_2$ particles are in close contact with each other in advance and then $SiO_2$ is placed in the gaps between the $RuO_2$ particles as a binder. This configuration assures more area where the $RuO_2$ particles are in contact with each other and does not allow the melted glass frit to get into the contact surface of the $RuO_2$ particles and then inhibit their contact so as not to increase the resistance, and thus the resistance of the conductive intermediate layer can be lowered. In addition, since the $RuO_2$ dispersion to be applied has a lower viscosity than that of a paste, the conductive intermediate layer can be made thinner than the one produced using a paste. Moreover, since the $RuO_2$ layer with many of the $RuO_2$ particles that are in close contact with each other is formed directly on the thermistor body in advance, the conductive intermediate layer has a low resistance, whereby the increase in resistance can be suppressed even when peeling of the electrode proceeds in a heat cycle test.

A method for producing a thermistor element according to a fourth aspect of the present invention is characterized by the method according to the third aspect of the present invention, wherein the electrode forming step includes applying a noble metal paste containing a noble metal on the conductive intermediate layer and heating the applied noble metal paste for baking to form the electrode layer of the noble metal.

Specifically, since this method for producing a thermistor element comprises applying a noble metal paste containing a noble metal on the conductive intermediate layer and heating the applied noble metal paste for baking to form the electrode layer of a noble metal, baking of the noble metal paste can make the contact of the $RuO_2$ particles very closer with each other. In addition, since glass frit can melt and get into the gaps between the $RuO_2$ particles that cannot be completely filled with a silica sol-gel solution, the glass frit can serve as a binder for firmly binding the $RuO_2$ particles to each other so as to make the conductive intermediate layer stable. Note that since the $RuO_2$ particles are in very close contact with each other by the $SiO_2$ derived from a silica sol-gel solution, the $RuO_2$ particles cannot be inhibited from being in contact with each other even when the glass frit in the noble metal paste melts and penetrates into the gaps between the $RuO_2$ particles.

A method for producing a thermistor element according to a fifth aspect of the present invention is characterized by the method according to the third or fourth aspect of the present invention, wherein the thickness of the $RuO_2$ layer is 100 to 1000 nm.

Specifically, in this method for producing a thermistor element, since the thickness of the $RuO_2$ layer is 100 to 1000 nm, the conductive intermediate layer can be made thinner but have a sufficient resistance. If the thickness of the $RuO_2$ layer is less than 100 nm, the adherence to the thermistor body and the resistance thereof may become insufficient. As long as the $RuO_2$ layer has a thickness of up to 1000 nm, a sufficiently low resistance and enough adherence can be attained, but in order to obtain the $RuO_2$ layer having a thickness of more than 1000 nm, the amount of the $RuO_2$ particles to be used can be increased more than necessary, leading to an increase in cost.

Effects of the Invention

According to the present invention, the following effects may be provided.

Specifically, according to the thermistor element of the present invention, since the conductive intermediate layer has an aggregation structure of $RuO_2$ particles that are in electrical contact with each other where $SiO_2$ is placed in the gaps in the aggregation structure, and has a thickness of 100 to 1000 nm, the conductive intermediate layer can have a low resistance even if it is thin, and the increase in resistance can be suppressed even when peeling of the electrode proceeds in a heat cycle test or the like.

In addition, according to the method for producing a thermistor element of the present invention, since the $RuO_2$ dispersion containing $RuO_2$ particles and an organic solvent is applied on the thermistor body and it is dried to form a $RuO_2$ layer, and moreover since a silica sol-gel solution containing $SiO_2$, an organic solvent, water, and an acid is applied on the $RuO_2$ layer and it is dried with the silica sol-gel solution being penetrated into the $RuO_2$ layer to form the conductive intermediate layer, the $RuO_2$ layer is formed with the $RuO_2$ particles being in close contact with each other in advance using a $RuO_2$ dispersion and the $SiO_2$ of a silica sol-gel solution is placed in the gaps between the $RuO_2$ particles, whereby the resistance of the conductive intermediate layer can be lowered.

Therefore, an reliable thermistor element can be provided which includes a conductive intermediate layer that can have a thinner profile but have a lower resistance than the one produced using a paste containing glass frit, and which can be produced at a lower cost, whereby the increase of the resistance can be suppressed in a heat cycle test or the like even when peeling of the electrode proceeds.

BRIEF DESCRIPTION OF THE DRAWINGS

FIG. 2 is a cross-sectional view of the thermistor element according to the present embodiment.

FIG. 3 is a schematic enlarged cross-sectional view of the thermistor element according to the present embodiment.

FIG. 4 is a SEM photograph of a cross section of a thermistor element produced according to the Example of a thermistor element and a method for producing the same of the present invention.

FIG. 5 is a SEM photograph of a cross section of the thermistor element produced according the Example of the present invention before forming an electrode layer.

FIG. 6 is a SEM photograph of the surface of the conductive intermediate layer produced according the Example of the present invention before forming an electrode layer.

FIG. 7 is a graph showing heat cycle test results regarding the change in resistance (Δ25) with respect to the number of a heat cycle for the thermistor element according to the Example of the present invention.

DESCRIPTION OF THE EMBODIMENTS

Figure 1:
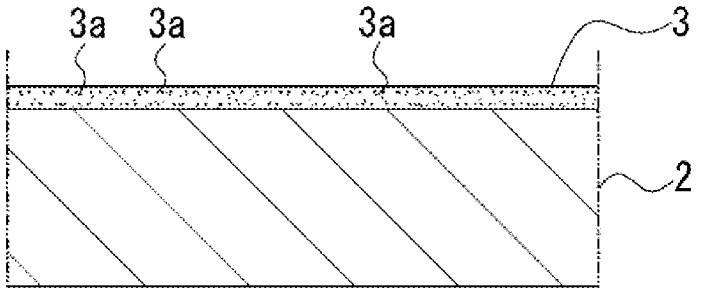
FIG. 1(*a*), FIG. 1(*b*) and FIG. 1(*c*) show cross-sectional views of a thermistor element in the order of steps according to one embodiment of a thermistor element and a method for producing the same of the present invention.
Figure 1:
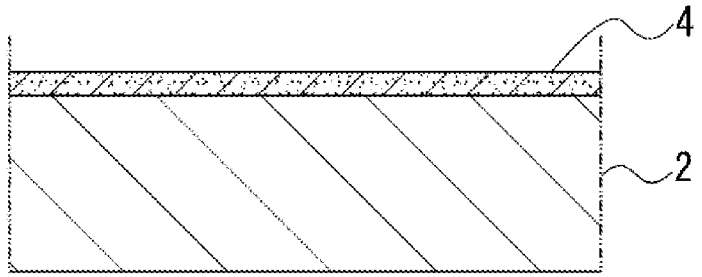
Figure 1:
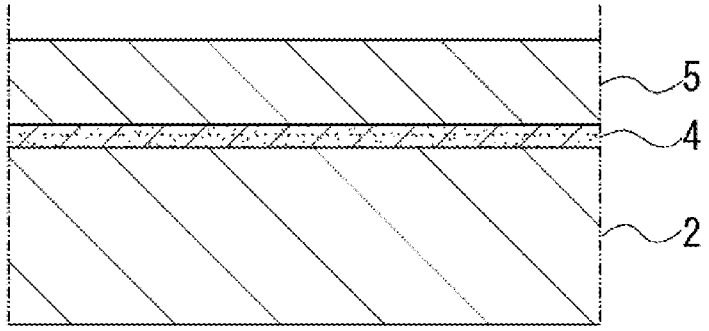
Figure 1:
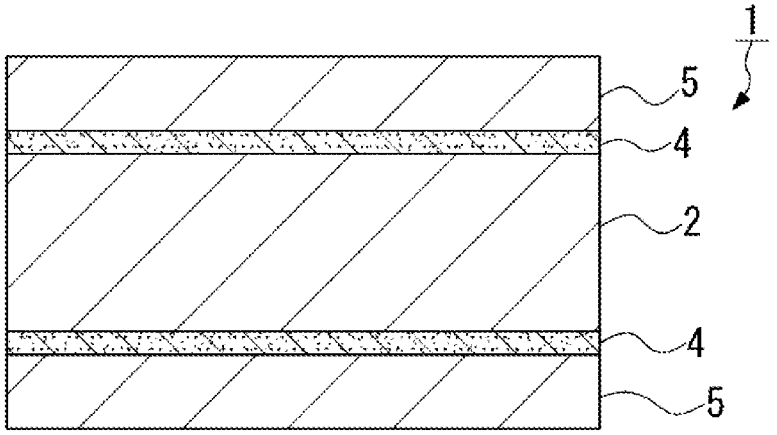

Hereinafter, a thermistor element and a method for producing the same according to one embodiment of the present invention will be described with reference to FIGS. 1 to 3. In the drawings used in the following description, the scale of each component is changed as appropriate so that each component is recognizable or is readily recognized.

As shown in FIGS. 1 to 3, a thermistor element 1 according to the present embodiment includes a thermistor body 2 made of a thermistor material, a conductive intermediate layer 4 formed on the thermistor body 2, and an electrode layer 5 formed on the conductive intermediate layer 4.

The conductive intermediate layer 4 has an aggregation structure of $RuO_2$ particles 3*a* that are in electrical contact with each other where $SiO_2$ is placed in the gaps in the aggregation structure, and has a thickness of 100 to 1000 nm. Specifically, the aggregation structure described above is constituted by the $RuO_2$ particles that are in contact and electrical conduction with each other where $SiO_2$ is placed in the gaps partially created in the aggregation structure.

This thermistor element 1 exhibits a rate of change in resistance at 25° C. of less than 2.5% before and after repeating a heat cycle test 50 times with one cycle consisting of a test conducted at −55° C. for 30 minutes and one at 200° C. for 30 minutes.

As shown in FIG. 1(*a*), FIG. 1(*b*) and FIG. 1(*c*), a method of producing the thermistor element 1 according to the present embodiment includes an intermediate layer forming step for forming the conductive intermediate layer 4 on the thermistor body 2 made of a thermistor material and an electrode forming step for forming the electrode layer 5 on the conductive intermediate layer 4.

The intermediate layer forming step described above includes applying a $RuO_2$ dispersion containing the $RuO_2$ particles 3*a* and an organic solvent on the thermistor body 2 and drying it to form a $RuO_2$ layer 3 as shown in FIG. 1(*a*), and applying a silica sol-gel solution containing $SiO_2$, an organic solvent, water, and an acid on the $RuO_2$ layer 3 and drying it with the silica sol-gel solution being penetrated into the $RuO_2$ layer 3 to form the conductive intermediate layer 4 as shown in FIG. 1(*b*).

The electrode forming step described above includes applying a noble metal paste containing a noble metal on the conductive intermediate layer 4 and heating the applied noble metal paste for baking to form an electrode layer 5 of a noble metal as shown in FIG. 1(*c*).

In addition, the thickness of the $RuO_2$ layer 3 is 100 to 1000 nm.

For the thermistor body 2, Mn—Co—Fe, Mn—Co—Fe—Al, Mn—Co—Fe—Cu, or the like may be employed for example. The thickness of this thermistor body 2 is, for example, 200 μm.

The $RuO_2$ dispersion described above is consisted of, for example, a $RuO_2$ ink made up by mixing the $RuO_2$ particles 3*a*, and acetylacetone and ethanol as organic solvents.

The $RuO_2$ particles 3*a* having an average particle size of 10 to 100 nm may be used, but the particles having an average particle size of about 50 nm is preferred.

The organic solvent may contain a dispersant, which is preferably a polymer type having a plurality of adsorbing groups.

The silica sol-gel solution described above is a mixture of, for example, $SiO_2$, ethanol, water, and nitric acid. In addition, other organic solvents except ethanol as described above may be used as the organic solvent in this silica sol-gel solution. In addition, the acid used in the silica sol-gel solution may function as a catalyst for facilitating hydrolysis, and other acids may also be used except nitric acid as described above.

The noble metal paste described above is, for example, an Au paste containing glass frit.

In the intermediate layer forming step, since the $RuO_2$ dispersion containing the $RuO_2$ particles 3*a* and an organic solvent is applied on the thermistor body 2 and it is dried to form the $RuO_2$ layer 3, the $RuO_2$ layer 3 is formed with many of the $RuO_2$ particles 3*a* that are in close contact with each other at this stage.

Specifically, when the $RuO_2$ dispersion containing the $RuO_2$ particles 3*a* is applied on the thermistor body 2 by spin-coating or the like and it is dried, for example, at 150° C. for 10 minutes, the acetylacetone and ethanol contained in the $RuO_2$ dispersion are evaporated to form the $RuO_2$ layer 3 with the $RuO_2$ particles 3*a* being in contact with each other. This $RuO_2$ layer 3 has fine gaps created in the area without containing the $RuO_2$ particles 3*a* that are in a close contact each other.

Next, when the silica sol-gel solution containing $SiO_2$, an organic solvent, water, and an acid is applied on the $RuO_2$ layer 3 and it is dried with the silica sol-gel solution being penetrated into the $RuO_2$ layer 3 to form the conductive intermediate layer 4, the conductive intermediate layer 4 can have an aggregation structure of the $RuO_2$ particles 3*a* that are in close contact with each other where the silica sol-gel solution is penetrated into the gaps therein so that the $SiO_2$ is placed in the gaps after dried. Since the silica sol-gel solution can be cured when dried so as to give a high purity of $SiO_2$, it can provide strength to the conductive intermediate layer 4 and serve to make the thermistor body 2 firmly adhered to the conductive intermediate layer 4.

Specifically, when a silica sol-gel solution is applied on the $RuO_2$ layer 3 by spin-coating or the like, the silica sol-gel solution penetrates into the fine gaps between the $RuO_2$ particles 3*a* in the $RuO_2$ layer 3. Then, it is dried, for example, at 150° C. for 10 minutes, the ethanol, water, and nitric acid are evaporated to leave only $SiO_2$ in the gaps. The resulting $SiO_2$ can function as a binder for the $RuO_2$ particles 3*a*. In this way, the conductive intermediate layer 4 is formed with $SiO_2$ being placed in the fine gaps between the $RuO_2$ particles 3*a* that are in contact with each other.

Next, when a noble metal paste is applied on the conductive intermediate layer 4 and it is baked, for example, at 850° C. for 10 minutes, the heating can make the contact of the $RuO_2$ particles 3*a* very closer with each other. In addition, the melted glass frit can penetrate into the gaps between the $RuO_2$ particles 3*a* that cannot be completely filled with the silica sol-gel solution.

Thus, the thermistor element 1 is produced in which the electrode layer 5 made of Au is formed on the conductive intermediate layer 4, as shown in FIGS. 2 and 4.

As described above, in the thermistor element 1 according to the present embodiment, since the conductive intermediate layer 4 has an aggregation structure of the $RuO_2$ particles 3*a* that are in electrical contact with each other where $SiO_2$ is placed in the gaps in the aggregation structure, and has a thickness of 100 to 1000 nm, the aggregation structure of the $RuO_2$ particles 3*a* that are in contact with each other can assure enough electrical conductivity, while the $SiO_2$ that is placed in the gaps in the porous structure can serve as a binder for the aggregation structure. Therefore, the thin conductive intermediate layer 4 can have a low resistance even if it is thin, whereby the increase in resistance can be suppressed in a heat cycle test or the like even when peeling between the conductive intermediate layer 4 and the electrode layer 5 proceeds.

Moreover, with the thermistor element 1 according to the present embodiment, since the rate of change in resistance at 25° C. is less than 2.5% before and after repeating the heat cycle test described above, a temperature measurement can be stably performed with high reliability even under the environment where the temperature is greatly changed.

In addition, in the method for producing a thermistor element according to the present embodiment, the $RuO_2$ layer 3 is formed using a $RuO_2$ dispersion containing no glass frit so that the $RuO_2$ particles 3*a* are in close contact with each other in advance and then $SiO_2$ is placed in the gaps between the $RuO_2$ particles 3*a* so as to function as a binder. This configuration assures more area where the $RuO_2$ particles 3*a* are in contact with each other, and does not allow the melted glass frit to get into the contact surface of the $RuO_2$ particles 3*a* and then inhibit their contact so as not to increase the resistance, and thus the resistance of the conductive intermediate layer 4 can be lowered. On the other hand, in a conventional intermediate layer that is made from a $RuO_2$ paste containing glass frit, the glass frit may inhibit the $RuO_2$ particles 3*a* from being in sufficiently close contact with each other.

In addition, in the method for producing a thermistor element according to the present embodiment, since the $RuO_2$ dispersion to be applied has a lower viscosity than that of a paste, the conductive intermediate layer 4 can be made thinner than the one produced using a paste. Moreover, since the $RuO_2$ layer 3 with many of the $RuO_2$ particles 3*a* that are in close contact with each other is formed directly on the thermistor body 2 in advance, the conductive intermediate layer 4 can have a low resistance, whereby the increase in resistance can be suppressed in a heat cycle test or the like even when peeling of the electrode proceeds.

In addition, since the method according to the present embodiment includes applying a noble metal paste containing a noble metal on the conductive intermediate layer 4 and heating the applied noble metal paste for baking to form the electrode layer 5 of a noble metal, baking of the noble metal paste can make the contact of the $RuO_2$ particles 3*a* very closer with each other. In addition, since the melted $SiO_2$ can penetrate into the gaps between the $RuO_2$ particles 3*a* that cannot be completely filled with a silica sol-gel solution, it can serve as a binder for firmly binding the $RuO_2$ particles 3*a* to each other so as to make the conductive intermediate layer 4 stable.

Moreover, since the thickness of the $RuO_2$ layer 3 is 100 to 1000 nm, the conductive intermediate layer 4 can be made thinner but have a sufficient resistance. If the thickness of the $RuO_2$ layer 3 is less than 100 nm, the adherence thereof to the thermistor body 2 may become insufficient. As long as the $RuO_2$ layer 3 has a thickness of up to 1000 nm, a sufficiently low resistance and enough adherence can be attained, but in order to obtain the $RuO_2$ layer 3 having a thickness of more than 1000 nm, the amount of the $RuO_2$ particles 3*a* to be used can be increased more than necessary, leading to an increase in cost.

Example 1

FIG. 4 is a SEM photograph of a cross section of the thermistor element 1 produced according to the embodiment described above, and FIGS. 5 and 6 are SEM photographs of the cross section of the thermistor element 1 and the surface of the conductive intermediate layer respectively before forming an electrode layer.

As can be seen from these photographs, the conductive intermediate layer is formed with the $RuO_2$ particles being in contact and close contact with each other.

The thermistor element 1 produced according to the Example was a chip thermistor having a size of 1.0×1.0×0.2 mm in a chip shape, that is, a whole size of 1.0×1.0 mm in a planar view with a thickness of 0.2 mm.

This thermistor element 1 was mounted on a gold-metallized AlN substrate by an Au—Sn foil soldering in a $N_2$ flow at 325° C. Then, the AlN substrate having this thermistor element mounted thereon was fixed by an adhesive on a printed circuit board on which wiring pattern is formed, and Au wire bonding was done to this board so as to produce an evaluation circuit as a sample for evaluation.

Table 1 and FIG. 7 show the heat cycle test results regarding the rate of change in resistance at 25° C. before and after repeating a heat cycle test 25 and 50 times with one cycle consisting of a test conducted at −55° C. for 30 minutes and one at 200° C. for 30 minutes. In this heat cycle test, a test at a normal temperature (25° C.) for 3 minutes was performed between the test at −55° C. for 30 minutes and the one at 200° C. for 30 minutes.

A thermistor element according to the Comparative Example was also produced, wherein an Au paste was directly applied on the thermistor body without using the conductive intermediate layer of the present invention and it was baked. Table 1 and FIG. 7 show the test results for the Comparative Example as well. Note that the test results are expressed as the mean value of measurements for 20 elements according to each of the Example and Comparative Example.

As can be seen from these heat cycle test results, the resistance was significantly increased in all the elements according to the Comparative Example, whereas the rates of change in resistance were small for all the elements according to the Example employing the conductive intermediate layer produced according to the method of the present invention as described above. The following is believed to be the reason for the above results. In the Comparative Example, the resistance is significantly increased as peeling of the electrode is extended and the peeling rate of an electrode is increased by the heat cycle test because they have an intermediate layer having a high resistance, whereas in the Example of the present invention, the increase of the resistance can be suppressed even when peeling of the electrode is caused because the conductive intermediate layer has a low resistance. These test results are also consistent with the simulation results regarding the change in resistance associated with the change in the peeling rate of the electrode.

TABLE 1

| | BAKING TIME [min] | THICKNESS OF INTERMEDIATE LAYER [nm] | INITIAL VALUE R25[Ω] | 25 cycs R25[Ω] | 25 cycs ΔR25 | 50 cycs R25[Ω] | 50 cycs ΔR25 |
|---|---|---|---|---|---|---|---|
| COMPARATIVE EXAMPLE 1 | 10 | — | 3772 | 4663 | 23.6% | 5147 | 36.4% |
| COMPARATIVE EXAMPLE 2 | 30 | — | 3744 | 4113 | 9.9% | 4291 | 14.6% |
| COMPARATIVE EXAMPLE 3 | 60 | — | 3728 | 4728 | 26.8% | 5030 | 34.9% |
| EXAMPLE 1 | 10 | 150 | 3699 | 3754 | 1.5% | 3781 | 2.2% |
| EXAMPLE 2 | 10 | 210 | 3756 | 3804 | 1.3% | 3807 | 1.3% |
| EXAMPLE 3 | 30 | 210 | 3690 | 3707 | 0.5% | 3713 | 0.6% |
| EXAMPLE 4 | 60 | 240 | 3672 | 3704 | 0.9% | 3710 | 1.0% |
| EXAMPLE 5 | 10 | 440 | 3672 | 3697 | 0.7% | 3703 | 0.8% |
| EXAMPLE 6 | 10 | 850 | 3675 | 3683 | 0.2% | 3683 | 0.2% |

The technical scope of the present invention is not limited to the aforementioned embodiments and Example, but the present invention may be modified in various ways without departing from the scope or teaching of the present invention.

Reference Numerals

1: thermistor element, 2: thermistor body, 3: $RuO_2$ layer, 3*a*: $RuO_2$ particles, 4: conductive intermediate layer, 5: electrode layer

What is claimed is:

1. A thermistor element comprising:

a thermistor body made of a thermistor material;

a conductive intermediate layer formed on the thermistor body; and an electrode layer formed on the conductive intermediate layer, wherein the conductive intermediate layer has an aggregation structure of $RuO_2$ particles that are in electrical contact with each other where $SiO_2$ is placed in the gaps in the aggregation structure, and has a thickness of 100 to 1000 nm.

2. The thermistor element according to claim 1, wherein the rate of change in resistance at 25° C. is less than 2.5% before and after repeating a heat cycle test 50 times with one cycle consisting of a test conducted at −55° C. for 30 minutes and one at 200° C. for 30 minutes.

3. A method for producing a thermistor element comprising:

an intermediate layer forming step for forming a conductive intermediate layer on a thermistor body made of a thermistor material; and an electrode forming step for forming an electrode layer on the conductive intermediate layer, wherein the intermediate layer forming step includes:

applying a $RuO_2$ dispersion containing $RuO_2$ particles and an organic solvent on the thermistor body and drying it to form a $RuO_2$ layer, and applying a silica sol-gel solution containing $SiO_2$, an organic solvent, water, and an acid on the $RuO_2$ layer and drying it with the silica sol-gel solution being penetrated into the $RuO_2$ layer to form the conductive intermediate layer.

4. The method for producing a thermistor element according to claim 3, wherein the electrode forming step comprises:

applying a noble metal paste containing a noble metal on the conductive intermediate layer; and heating the applied noble metal paste for baking to form the electrode layer of the noble metal.

5. The method for producing a thermistor element according to claim 3, wherein the thickness of the $RuO_2$ layer is 100 to 1000 nm.

* * * * *